US010407876B2

(12) United States Patent
Joo et al.

(10) Patent No.: US 10,407,876 B2
(45) Date of Patent: Sep. 10, 2019

(54) HYDRAULIC SYSTEM OF CONSTRUCTION MACHINERY

(71) Applicant: DOOSAN INFRACORE CO., LTD., Incheon (KR)

(72) Inventors: Choon-Shik Joo, Bucheon-si (KR); A-Rim Lee, Incheon (KR)

(73) Assignee: DOOSAN INFRACORE CO., LTD., Incheon (KR)

( * ) Notice: Subject to any disclaimer, the term of this patent is extended or adjusted under 35 U.S.C. 154(b) by 4 days.

(21) Appl. No.: 15/578,918

(22) PCT Filed: Jun. 1, 2016

(86) PCT No.: PCT/KR2016/005799
§ 371 (c)(1),
(2) Date: Dec. 1, 2017

(87) PCT Pub. No.: WO2016/195374
PCT Pub. Date: Dec. 8, 2016

(65) Prior Publication Data

US 2018/0148907 A1 May 31, 2018

(30) Foreign Application Priority Data

Jun. 2, 2015 (KR) ..... 10-2015-0078092

(51) Int. Cl.
*E02F 9/22* (2006.01)
*E02F 9/14* (2006.01)

(52) U.S. Cl.
CPC ..... *E02F 9/2267* (2013.01); *E02F 9/14* (2013.01); *E02F 9/22* (2013.01); *E02F 9/2203* (2013.01); *E02F 9/2221* (2013.01)

(58) Field of Classification Search
CPC ..... E02F 9/2267; E02F 9/2221; E02F 9/22; E02F 9/14

(Continued)

(56) References Cited

U.S. PATENT DOCUMENTS 5,490,384 A * 2/1996 Lunzman ..... E02F 9/2221 60/327
6,267,041 B1 * 7/2001 Skiba ..... F15B 11/024 91/436

(Continued)

FOREIGN PATENT DOCUMENTS

DE 199 32 948 A1 2/2000
EP 1 211 359 A1 6/2002

(Continued)

OTHER PUBLICATIONS

International Search Report dated Sep. 1, 2016 for PCT/KR2016/005799, citing the above reference(s).

(Continued)

*Primary Examiner* — Hoang M Nguyen
(74) *Attorney, Agent, or Firm* — Hauptman Ham, LLP

(57) ABSTRACT

A hydraulic system for construction machinery comprises a regeneration valve unit including a first opening/closing valve installed in a first hydraulic line which connects a head-side chamber of a boom cylinder and a drain tank, to open and close the first hydraulic line, and a second opening/closing valve installed in a second hydraulic line which is branched from the first hydraulic line and is connected to a rod-side chamber of the boom cylinder, to open and close the second hydraulic line, a first check valve installed in the second hydraulic line between the rod-side chamber and the regeneration valve unit and configured to selectively drain a working oil discharged from the rod-side chamber to the drain tank, and a control unit configured to control opening and closing of the first opening/closing valve, the second opening/closing valve and the first check valve according to a control mode.

11 Claims, 7 Drawing Sheets

(58) Field of Classification Search
USPC ..... 91/433, 440, 461
See application file for complete search history.

(56) References Cited

U.S. PATENT DOCUMENTS

| | | | | |
|---|---|---|---|---|
| 6,877,417 | B2 * | 4/2005 | Shimada | E02F 9/2217 91/433 |
| 9,228,323 | B2 | 1/2016 | Kawasaki et al. | |
| 2012/0304630 | A1 | 12/2012 | Kawasaki et al. | |
| 2013/0047599 | A1 * | 2/2013 | Opdenbosch | F16D 48/02 60/464 |
| 2015/0267381 | A1 | 9/2015 | Kang | |
| 2015/0315768 | A1 | 11/2015 | Jeong et al. | |

FOREIGN PATENT DOCUMENTS

| | | | |
|---|---|---|---|
| EP | 2 378 009 | A2 | 10/2011 |
| KR | 10-2005-0000820 | A | 1/2005 |
| KR | 10-2012-0092173 | A | 8/2012 |
| KR | 10-2015-0030328 | A | 3/2015 |
| WO | 02/055793 | A1 | 7/2002 |
| WO | 2013/115530 | A1 | 8/2013 |
| WO | 2014/098284 | A1 | 6/2014 |

OTHER PUBLICATIONS

European Search Report dated Dec. 24, 2018, issued in corresponding European Patent Application No. 16803729.9, citing the above references.

* cited by examiner

HYDRAULIC SYSTEM OF CONSTRUCTION MACHINERY

CROSS REFERENCE TO RELATED APPLICATION

This application claims the priority of Korean Patent Application No. 10-2015-0078092, filed on Jun. 2, 2015, in the KIPO (Korean Intellectual Property Office). Further, this application is the National Phase Application of International Application No. PCT/KR2016/005799, filed on Jun. 1, 2016, which designates the United States and was published in Japan. Both of the priority documents are hereby incorporated by reference in their entireties.

TECHNICAL FIELD

The present invention relates to a hydraulic system of construction machinery, more particularly, to a hydraulic system for controlling a boom cylinder configured to raise and lower a boom.

BACKGROUND ART

Construction machinery such as excavator may use various attachments under work conditions. For example, a bucket may be used for an excavation work or a ground leveling work, and a breaker may be used for a stone crush work.

When the bucket is used, the bucket may move forward and backward to perform the ground leveling work. For the ground leveling work, the force of the bucket acting on a ground may need to be maintained constant. Accordingly, a precise and accurate control of a boom and the bucket may be required and thus an operator feels tiredness with the manipulation.

When the breaker is used, the boom may be bounded by reaction force when the breaker crushes stone. Accordingly, the force of the breaker acting on the stone may need to be maintained constant and a precise and accurate control of the boom and the breaker may be required.

On the other hand, a hydraulic pump may supply a working oil to a rod side of a boom cylinder to lower the boom. On this occasion, the boom may descend faster than intended because of inertia load of dead load of the boom and the bucket. That is, a speed of the working oil discharged from a cylinder rod side of the boom cylinder may be greater than a speed of the working oil supplied from the hydraulic pump to a cylinder head side of the boom cylinder. Thus, a cavitation phenomenon within the cylinder rod side of the boom cylinder may occur.

DISCLOSURE OF THE INVENTION

Problems to be Solved

An object of the present invention provides a hydraulic control system for construction machinery capable of controlling discharge of a working oil within a boom cylinder during a ground leveling work or a breaking work.

Another object of the present invention provides a hydraulic control system for construction machinery capable of recovering a working oil discharged from a boon cylinder while a boom descends.

Means to Solve the Problems

According to example embodiments, a hydraulic system for construction machinery includes a regeneration valve unit including a first opening/closing valve installed in a first hydraulic line which connects a head-side chamber of a boom cylinder and a drain tank and configured to open and close the first hydraulic line, and a second opening/closing valve installed in a second hydraulic line which is branched from the first hydraulic line and is connected to a rod-side chamber of the boom cylinder and configured to open and close the second hydraulic line, the boom cylinder including the head-side chamber in a side of a cylinder head and the rod-side chamber in a side of a cylinder rod, a first check valve installed in the second hydraulic line between the rod-side chamber and the regeneration valve unit and configured to selectively drain a working oil discharged from the rod-side chamber to the drain tank, and a control unit configured to control opening and closing of the first opening/closing valve, the second opening/closing valve and the first check valve according to a control mode.

In example embodiments, the hydraulic system for construction machinery may further include a second check valve installed in the first hydraulic line between the regeneration valve unit and the drain tank and configured to open and close the first hydraulic line to prevent the working oil discharged from the head-side chamber and the rod-side chamber from flowing to the drain tank.

In example embodiments, the hydraulic system for construction machinery may further include a third check valve installed in the first hydraulic line between the head-side chamber and the first opening/closing valve and configured to open and close the first hydraulic line to selectively drain the working oil discharged from the head-side chamber to the drain tank through the first opening/closing valve.

In example embodiments, the control unit may include a controller configured to apply electronic signals to a plurality of control valves according to the control mode, the control valves applying pilot pressure for opening and closing the first opening/closing valve, the second opening/closing valve and the first check valve.

In example embodiments, the control unit may further include a selection portion configured to select a breaker mode or a floating mode as the control mode, the breaker mode operable to connect the head-side chamber to the drain tank, the floating mode operable to connect the head-side chamber and the rod-side chamber to the drain tank.

In example embodiments, when the breaker mode is selected, the control unit may apply the pilot pressure to the first opening/closing valve and the second opening/closing valve.

In example embodiments, when the floating mode is selected, the control unit may apply the pilot pressure to the first opening/closing valve, the second opening/closing valve and the first check valve.

In example embodiments, the first and second opening/closing valves may include a solenoid valve respectively and the control unit may apply electronic signals for opening and closing the first and second opening/closing valves according to the control mode.

In example embodiments, the hydraulic system for construction machinery may further include a regeneration device configured to recover energy of the cylinder, and wherein the first opening/closing valve may selectively connect the head-side chamber to the drain tank or the regeneration device.

In example embodiments, the first opening/closing valve may have a first spool position where the first hydraulic line is opened such that the head-side chamber is connected to the drain tank and a second spool position where the first hydraulic line is connected to a regeneration connection line such that the head-side chamber is connected to the regeneration device.

In example embodiments, when the breaker mode or the floating mode is selected, the control unit may switch the first opening/closing valve to the first spool position to connect the head-side chamber to the drain tank, and when a regeneration mode is selected, the control unit may switch the first opening/closing valve to the second spool position to connect the head-side chamber to the regeneration device.

In example embodiments, the regeneration device may include an accumulator or a hydraulic motor.

In example embodiments, the second hydraulic line may be connected to a portion of the first hydraulic line in the front of the first opening/closing valve or in the rear of the first opening/closing valve.

Effects of the Invention

A hydraulic system for construction machinery in accordance with example embodiments may connect a boom cylinder to a drain tank, and may apply a constant force on a ground using dead weight of a boom without manipulation of the boom.

Further, when the boom descends, a working oil discharged from a cylinder head side of a boom cylinder may be recovered to be supplied to a cylinder rod side of the boom cylinder. Thus, a cavitation phenomenon within the boom cylinder due to the descent of the boom may be suppressed.

However, the effect of the invention may not be limited thereto, and may be expanded without being deviated from the concept and the scope of the present invention.

BEST MODE FOR CARRYING OUT THE INVENTION

Figure 1:
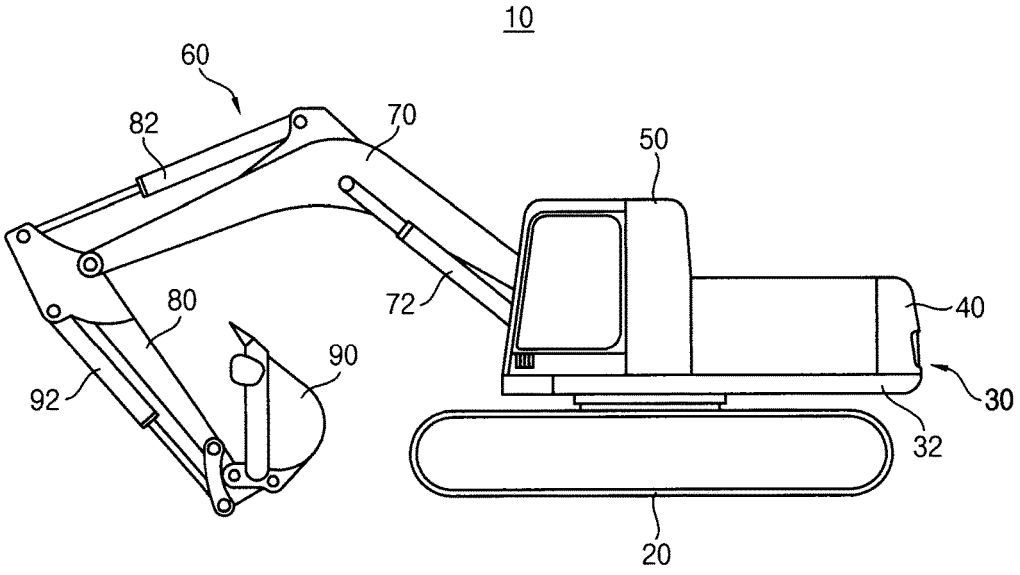
FIG. 1 is a side view illustrating construction machinery in accordance with example embodiments.

Hereinafter, preferable embodiments of the present invention will be explained with reference to the attached drawings. Various example embodiments will be described more fully hereinafter with reference to the accompanying drawings, in which example embodiments are shown. Example embodiments may, however, be embodied in many different forms and should not be construed as limited to example embodiments set forth herein. Rather, these example embodiments are provided so that this disclosure will be thorough and complete, and will fully convey the scope of example embodiments to those skilled in the art. In the drawings, the sizes and relative sizes of components or elements may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element or layer is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of example embodiments.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of example embodiments. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a side view illustrating construction machinery in accordance with example embodiments.

Referring to FIG. 1, construction machinery 10 may include a lower travelling body 20, an upper swing body 30 mounted rotatably on the lower travelling body 20, and a cabin 50 and a work apparatus 60 installed in the upper body 30.

The lower travelling body 20 may support the upper swing body 30, and may use a driving force generated by an engine (not illustrated) to travel the construction machinery 10. The lower travelling body 20 may be a crawler type travelling body. Alternatively, the lower travelling body 20 may be a wheel type travelling body including driving wheels. The upper swing body 30 may include an upper frame 32 as a base, and may rotate on a plane parallel with a ground to determine a working direction.

The cabin 50 may be installed in a left front portion of the upper frame 32, and the work apparatus 60 may be installed in a front body of the upper frame 32. A counterweight 40 may be mounted in a rear portion of the upper frame 32 to maintain a balance with an external force when the construction machinery lifts a load, thereby maintaining stability.

The work apparatus 60 may include a boom 70, an arm 80 and a bucket 90. A boom cylinder 72 may be installed between the boom 70 and the upper frame 32 to control a movement of the boom 70. An arm cylinder 82 may be installed between the arm 80 and the boom 70 to control a movement of the arm 80. A bucket cylinder 82 may be installed between the bucket 90 and the arm to control a movement of the bucket 90. As the boom cylinder 72, the arm cylinder 82 and the bucket cylinder 92 expand or contract, the boom 70, the arm 80 and the bucket 90 may implement various movements, so that the work apparatus 60 may perform various works. The boom cylinder 72, the arm cylinder 82 and the bucket cylinder 92 may expand or contract by a working oil supplied from a hydraulic pump (not illustrated).

On the other hand, various attachments in place of the bucket 90 may be attached to an end portion of the arm 80. For example, the bucket may be used for an excavation work or a ground leveling work, and a breaker (not illustrated) may be used for a stone crush work. Additionally, a cutter may be used for cutting scrap metal.

Figure 2:
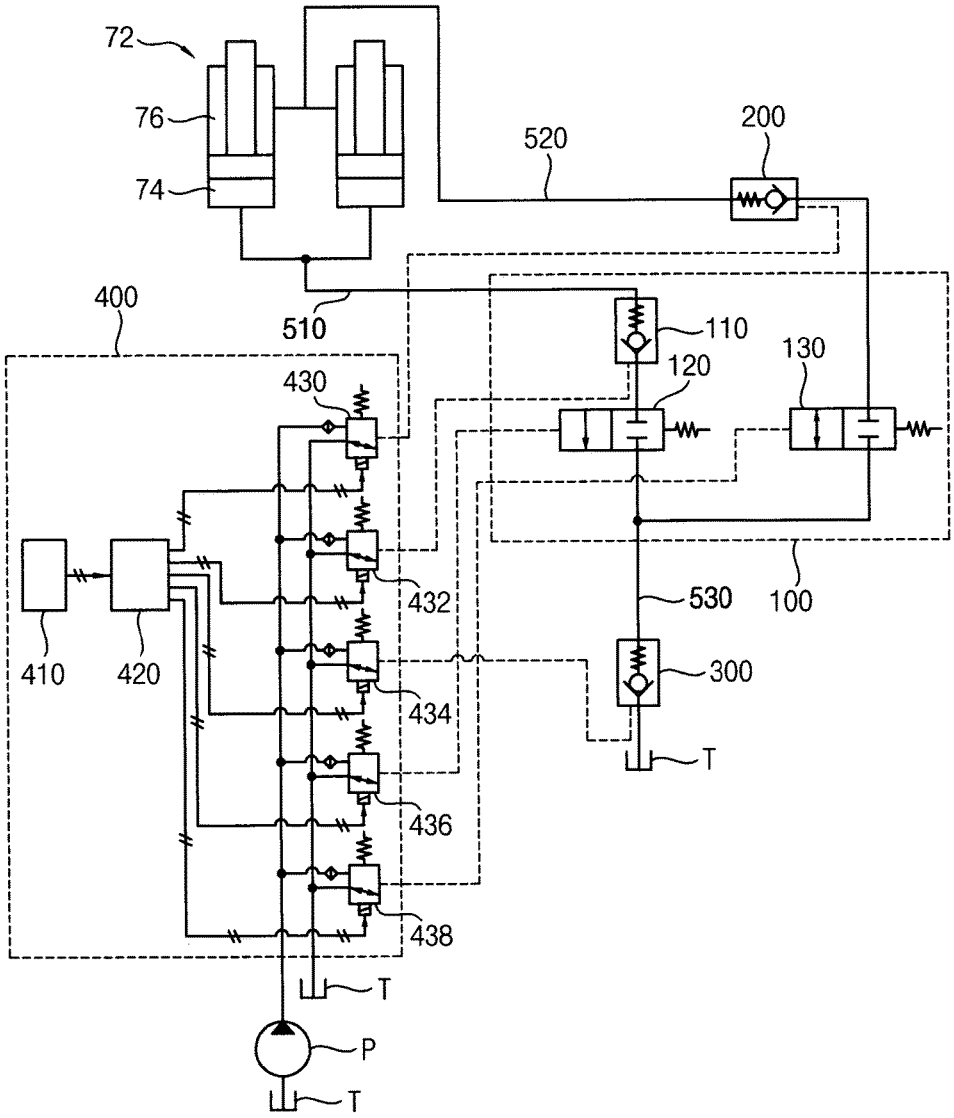
FIG. 2 is a hydraulic circuit diagram illustrating a hydraulic system for construction machinery in accordance with example embodiments.
Figure 3:
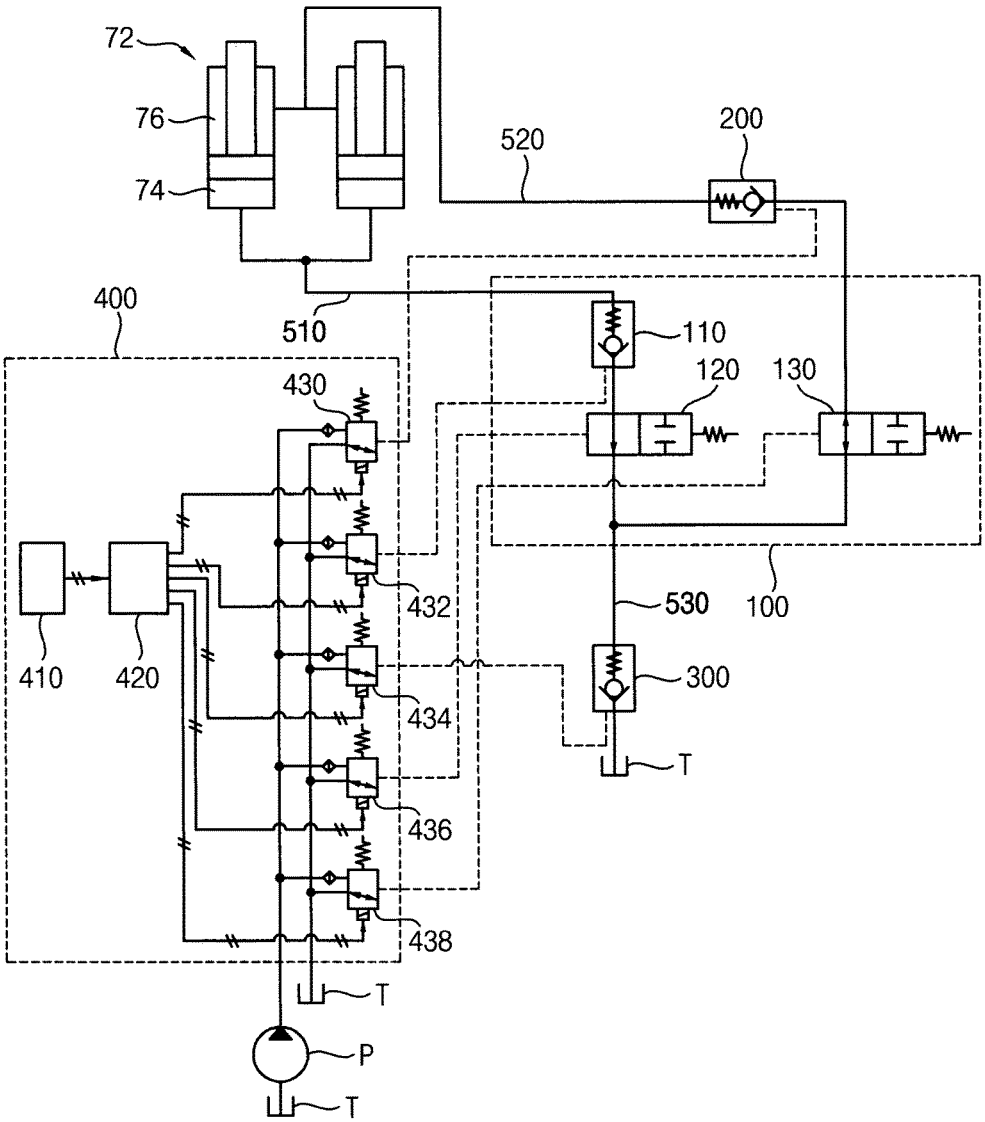
FIG. 3 is a hydraulic circuit diagram illustrating the hydraulic system in FIG. 2, when a control mode is selected.

FIG. 2 is a hydraulic circuit diagram illustrating a hydraulic system for construction machinery in accordance with example embodiments. FIG. 3 is a hydraulic circuit diagram illustrating the hydraulic system in FIG. 2, when a control mode is selected.

Referring to FIGS. 2 and 3, a hydraulic system for construction machinery in accordance with example embodiments may include a boom cylinder 72 having a head-side chamber, that is, a raising-side chamber 74 and a rod-side chamber, that is, a lowering-side chamber 76, a regeneration valve unit 100, a first check valve 200 and a control unit 400 configured to control the regeneration valve unit 100 and the first check valve 200. The regeneration valve unit 100 may include a first opening/closing valve 120 installed in a first hydraulic line 510 which connects the head-side chamber 74 and a drain tank T to open and close the first hydraulic line 510, and a second opening/closing valve 130 installed in a second hydraulic line 520 which is branched from a third hydraulic line 530 as a portion of the first hydraulic line 510 between the first opening/closing valve 120 and the drain tank T, that is, is branched from a portion of the first hydraulic line 510 in the rear of the first opening/closing valve 120 and is connected to the rod-side chamber 76 to open and close the second hydraulic line 520. The first check valve 200 may be installed in the second hydraulic line 520 between the rod-side chamber 76 and the regeneration valve unit 100 to selectively drain a working oil discharged from the rod-side chamber 76 to the drain tank T.

The head-side chamber 74 may be provided in a head side of the boom cylinder 72. As the working oil is supplied to the head-side chamber 74, the boom cylinder 72 may expand to raise the boom 70. On the contrary, the rod-side chamber 76 may be provided in a rod side of the boom cylinder 74. As the working oil is supplied to the rod-side chamber 76, the boom cylinder 72 may contract to lower the boom 70. The head-side chamber 74 may be connected to the first hydraulic line 510, and the rod-side chamber 76 may be connected to the second hydraulic line 520.

The regeneration valve unit 100 may be installed in the first hydraulic line 510 and the second hydraulic line 520 branched from the first hydraulic line 520, and may selectively drain the working oil discharged from the head-side chamber 74 to the drain tank T or supply the working oil to the rod-side chamber 76. The regeneration valve unit 100 may receive a pilot pressure from the below-mentioned control unit 400. When the pilot pressure is inputted to the regeneration valve unit 100, the first hydraulic line 510 may be connected to the second hydraulic line 520. Thus, the working oil discharged from the head-side chamber 74 may be supplied to the rod-side chamber 76 through the first hydraulic line 510 and the second hydraulic line 520.

In example embodiments, the regeneration valve unit 100 may include a third check valve 110, the first opening/closing valve 120, and the second opening/closing valve 130.

The third check valve 110 may be operatively installed in the first hydraulic line 510 to open and close the first hydraulic line 510, to prevent the working oil within the head-side chamber 74 from being discharged through the first hydraulic line 510. When the pilot pressure is inputted to the third check valve 110, the third check valve 110 may be held open to allow the working oil within the head-side chamber 74 to flow to the rod-side chamber 76 or drain to the drain tank T through the first hydraulic line 510. For example, the third check valve may be a pilot-operated check valve which is held open by the pilot pressure.

The first opening/closing valve 120 may be installed in the first hydraulic line 510 to selectively open and close the first hydraulic line 510. When the pilot pressure is inputted to the first opening/closing valve 120, the first opening/closing valve 120 may be held open so that the first hydraulic line 510 may be connected to the second hydraulic line 520.

The second opening/closing valve 130 may be installed in the second hydraulic line 520 to selectively open and close the second hydraulic line 520. When the pilot pressure is inputted to the second opening/closing valve 130, the second opening/closing valve 130 may be held open so that the rod-side chamber 76 may be connected to the first hydraulic line 510 through the second hydraulic line 520.

The first check valve 200 may be operatively installed in the second hydraulic line 520 between the rod-side chamber 76 and the second opening/closing valve 130 to open and close the second hydraulic line 510, to prevent the working oil within the rod-side chamber 76 from being discharged through the second hydraulic line 520. When the pilot pressure is inputted to the first check valve 200, the first check valve 200 may be held open to allow the working oil within the rod-side chamber 76 to drain to the drain tank T through the second hydraulic line 520 and the third hydraulic line 530. For example, the first check valve may be a pilot-operated check valve which is held open by the pilot pressure.

In example embodiments, the hydraulic system for construction machinery may further comprise a second check valve 300 configured to selectively connect the head-side chamber 74 and the rod-side chamber 76 to the drain tank T.

The second check valve 300 may be installed in the third hydraulic line 530 which connects the first opening/closing valve 120 and the drain tank T, to prevent the working oil discharged from the head-side chamber 74 and the rod-side chamber 76 from flowing to the drain tank T. When the pilot pressure is inputted to the second check valve 300, the second check valve 300 may be held open. Thus, the working oil within the head-side chamber 74 may be discharged to the drain tank T through the first hydraulic line 510 and the third hydraulic line 530 and the working oil within the rod-side chamber 76 may be discharged to the drain tank T through the second hydraulic line 520 and the third hydraulic line 530. For example, the second check valve may be a pilot-operated check valve which is held open by the pilot pressure.

The control unit 400 may include first to fifth control valves 430, 432, 434, 436 and 438 for applying the pilot pressure, a selection portion 410 for selecting a control mode, and a controller 420 for applying electronic signals to the first to fifth control valves 430, 432, 434, 436 and 438 according to the selected control mode.

For example, the control mode may include a breaker mode and a floating mode. The breaker mode may be selected for a crush work using a breaker to connect the head-side chamber 74 to the drain tank T. On the other hand, the floating mode may be selected for a ground leveling work using a bucket 90 to connect both the head-side chamber 74 and the rod-side chamber 76 to the drain tank T.

The selection portion 410 may output a selection signal to the controller 420 in response to a selection of an operator. For example, the selection portion 410 may include a selection switch for selecting the control mode. The operator may manipulate the selection switch to select one of the breaker mode and the floating mode.

The first to fifth control valves 430, 432, 434, 436 and 438 may generate a pilot pressure in response to an electronic signal outputted from the controller 420. The pilot pressure may be inputted to the regeneration valve unit 100, the first check valve 200 and the second check valve 300, respectively.

In particular, the first control valve 430 may apply a pilot pressure to the first check valve, the second control valve 432 may apply a pilot pressure to the third check valve 110, the third control valve 434 may apply a pilot pressure to the second check valve 300, the fourth control valve 436 may apply a pilot pressure to the first opening/closing valve 120, and the fifth control valve 438 may apply a pilot pressure to the second opening/closing valve 130.

The first to fifth control valves 430, 432, 434, 436 and 438 may receive a pilot oil from a pilot pump P respectively. For example, the pilot oil may include a material the same as the working oil.

The controller 420 may receive the selection signal from the selection portion 410 and accordingly control the first to fifth control valves 430, 432, 434, 436 and 438. In reticular, controller 420 may apply selectively an electronic signal to the first to fifth control valves 430, 432, 434, 436 and 438 according to the selected control mode.

When the breaker mode is selected, the controller 420 may apply electronic signals to the second to fifth control valves 432, 434, 436 and 438. The second to fifth control valves 432, 434, 436 and 438 may generate a pilot pressure in response to the electronic signal outputted from the controller 420 to open and close the valves of the regeneration valve unit 100 and the second check valve 300.

In particular, the third check valve 110 may be held open by the pilot pressure applied from the second control valve 432. The second check valve 300 may be held open by the pilot pressure from the third control valve 434. The first opening/closing valve 120 may be switched by the pilot pressure applied from the fourth control valve 436 to open the first hydraulic line 510. The second opening/closing valve 130 may be switched by the pilot pressure applied from fifth control valve 438 to open the second hydraulic line 520.

The work apparatus 60 including the boom 70 may be affected by gravity due to dead load. As the boom 70 descends by gravity, the boom cylinder 72 may be contracted. The working oil within the head-side chamber 74 may be discharged to the first hydraulic line 510 by the contraction of the boom cylinder 72. The discharged working oil may be drained to the drain tank T through the third check valve 110 and the first opening/closing valve 120 in the first hydraulic line 510 and the second check valve 300 in the third hydraulic line 530.

In this case, a portion of the working oil discharged from the head-side chamber 74 may be supplied to the rod-side chamber 76 through the second opening/closing valve 130 and the first check valve 200 in the second hydraulic line 520. That is, as the portion of the working oil within the head-side chamber 74 may be supplied to the rod-side chamber 76, the boom may be lowered by the gravity acting on the boom 70 without an extra supply of the working oil.

On the other hand, when the breaker is used to crush a stone, reaction force from the stone may be exerted on the boom 70 to raise the boom 70. In this case, if the breaker mode is selected, a weight of the work apparatus 60 including the boom 70 may be applied to an object such as the stone to offset the reaction force, thereby stably performing the breaking work.

When the floating mode is selected, the controller 420 may apply electronic signals to the first to fifth control valves 430, 432, 434, 436 and 438. The first to fifth control valves 430, 432, 434, 436 and 438 may generate a pilot pressure in response to the electronic signal outputted from the controller 420 to open and close the valves of the regeneration valve unit 100, the first check valve 200 and the second check valve 300.

In particular, the first check valve 200 may be held open by the pilot pressure from the first control valve 430. The third check valve 110 may be held open by the pilot pressure applied from the second control valve 432. The second check valve 300 may be held open by the pilot pressure from the third control valve 434. The first opening/closing valve 120 may be switched by the pilot pressure applied from the fourth control valve 436 to open the first hydraulic line 510. The second opening/closing valve 130 may be switched by the pilot pressure applied from fifth control valve 438 to open the second hydraulic line 520.

The head-side chamber 74 may connected to the drain tank T through the first hydraulic line 510 and the third hydraulic line 530, and the rod-side chamber 76 may be connected to the drain tank T through the second hydraulic line 520 and the third hydraulic line 530. That is, the boom 70 may move freely up and down with respect to the ground. Thus, when the ground leveling work is performed using the bucket 90, if the floating mode is selected, a weight of the work apparatus 60 including the boom 70 may be applied with respect to the ground, thereby improving manipulation convenience for an operator.

As mentioned above, the hydraulic system for construction machinery in accordance with example embodiments may be operated in the breaker mode or the floating mode, depending on work conditions.

In the case that the breaker mode is selected, even though a working oil is not supplied separately to the boom cylinder 72, the breaker may be prevented from bounding from the ground by only the weight of the boom 70. Further, as a portion of the working oil within the head-side chamber 74 of the boom cylinder 72 is supplied to the rod-side chamber 76, a cavitation phenomenon within the boom cylinder 72 due to the descent of the boom 70 may be suppressed.

In the case that the floating mode is selected, the head-side chamber 74 and the rod-side chamber 76 of the boom cylinder 72 may be connected to the drain tank T. Thus, when the ground leveling work is performed, a constant force may be applied to the ground by the weight of the boom 70 and may be applied with respect to the ground, and the boom 70 may move freely up and down with forward and backward movement of the bucket 90, thereby dramatically improving manipulation convenience for an operator.

Figure 4:
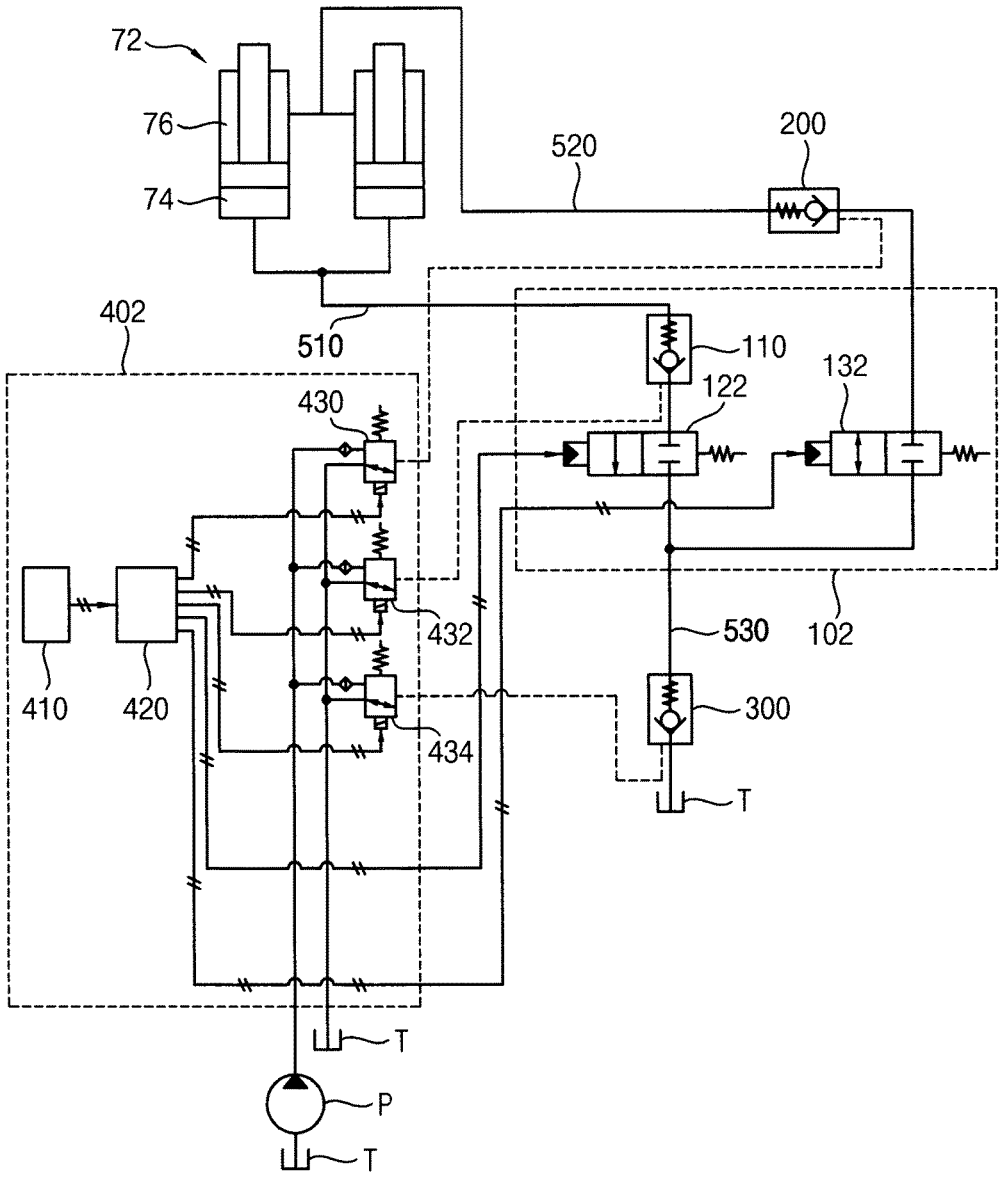
FIG. 4 is a hydraulic circuit diagram illustrating a hydraulic system for construction machinery in accordance with example embodiments.

FIG. 4 is a hydraulic circuit diagram illustrating a hydraulic system for construction machinery in accordance with example embodiments. The hydraulic system for construction machinery may be substantially the same as or similar to the hydraulic system for construction machinery as described with reference to FIGS. 2 and 3, except for a regeneration valve unit and a control unit. Thus, same reference numerals will be used to refer to the same or like elements and any further repetitive explanation concerning the above elements will be omitted.

Referring to FIG. 4, a hydraulic system for construction machinery in accordance with example embodiments may include a boom cylinder 72, a regeneration valve unit 102, a first check valve 200, a second check valve 300 and a control unit 402.

The regeneration valve unit 102 may include a first opening/closing valve 122 installed in a first hydraulic line 510 which connects a head-side chamber 74 of the boom cylinder 72 and a drain tank T to open and close the first hydraulic line 510, a third check valve 110 installed in the first hydraulic line 510 between the head-side chamber 74 and the first opening/closing valve 122 to open and close the first hydraulic line 110, and a second opening/closing valve 133 installed in a second hydraulic line 520 which is branched from a third hydraulic line 530 between the first opening/closing valve 122 and the drain tank T and is connected to a rod-side chamber 76 of the boom cylinder 72 to open and close the second hydraulic line 520.

For example, the first and second opening/closing valves 122 and 132 may be a solenoid valve.

The control unit 402 may include first to third control valves 430, 432 and 434 for applying a pilot pressure, a selection portion 410 for selecting a control mode, and a controller 420 for applying electronic signals to the first to third control valves 430, 432 and 434, the first opening/closing valve 122 and the second opening/closing valve 132 according to the selected control mode.

When a breaker mode is selected, the controller 420 may apply electronic signals to the second control valve 432, the third control valve 434, the first opening/closing valve 122 and the second opening/closing valve 132. The second and third control valves 432 and 434 may generate a pilot pressure in response to the electronic signal outputted from the controller 420 to open and close the third check valve 110 and the second check valve 300. The first and second opening/closing valves 122 and 132 may be switched to open the first and second hydraulic lines 510 and 520 respectively.

When a floating mode is selected, the controller 420 may apply electronic signals to the first to third control valves 430, 432 and 434, the first opening/closing valve 122 and the second opening/closing valve 132. The first to third control valves 430, 432 and 434 may generate a pilot pressure in response to the electronic signal outputted from the controller 420 to open and close the first check valve 200, the third check valve 110 and the second check valve 300. The first and second opening/closing valves 122 and 132 may be switched to open the first and second hydraulic lines 510 and 520 respectively.

Figure 5:
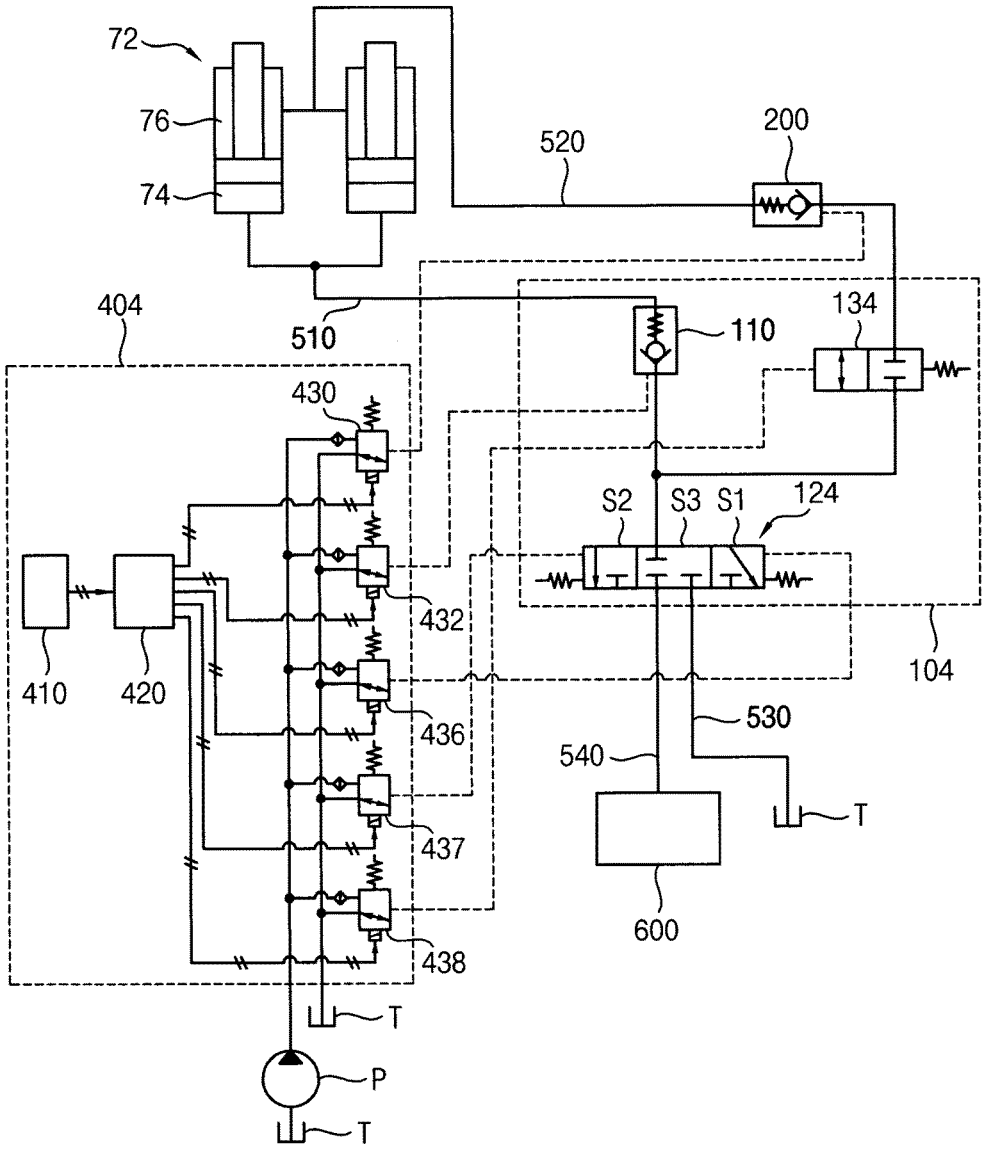
FIG. 5 is a hydraulic circuit diagram illustrating a hydraulic system for construction machinery in accordance with example embodiments.
Figure 6:
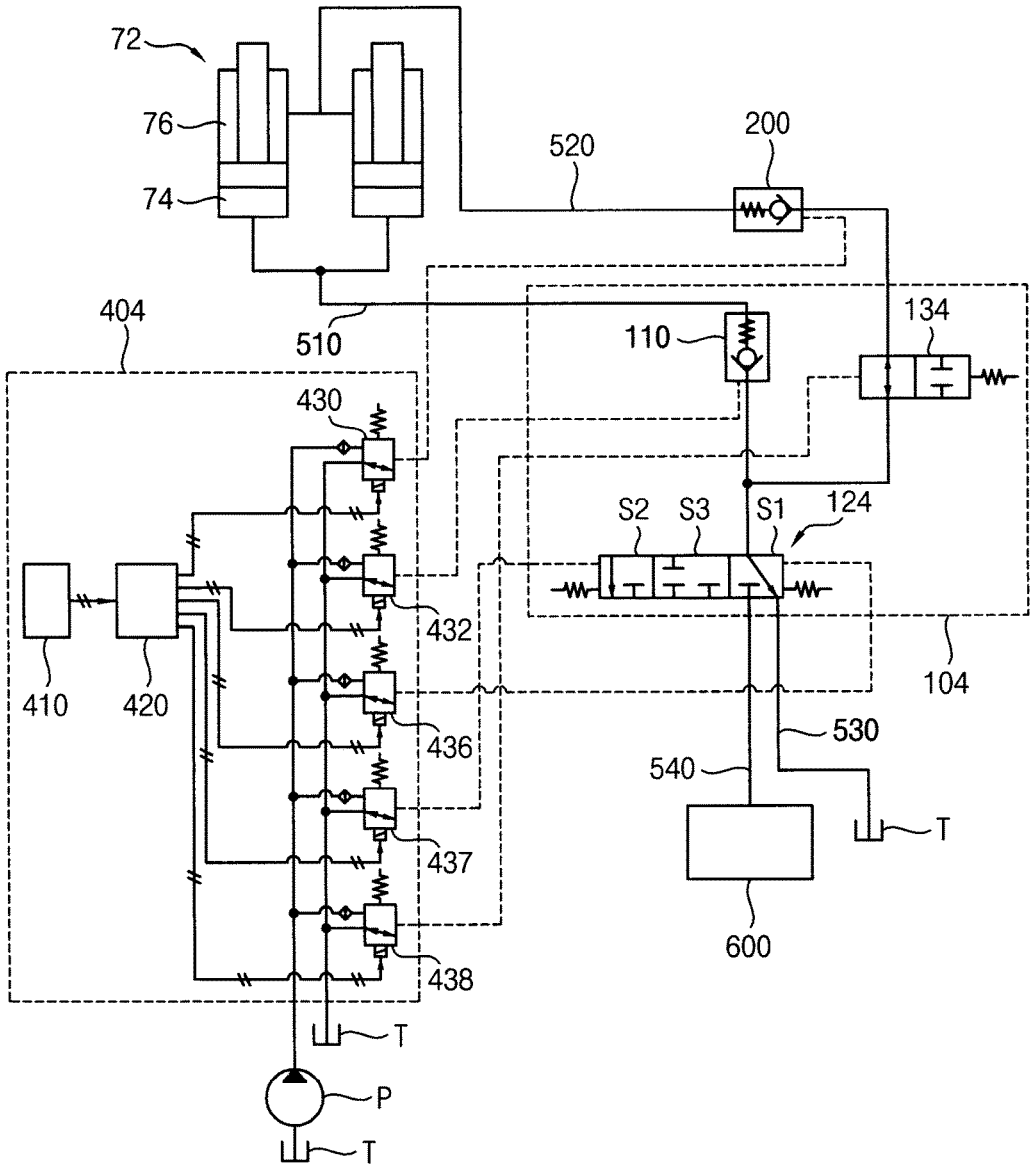
FIG. 6 is a hydraulic circuit diagram illustrating the hydraulic system in FIG. 5, when a control mode of a breaker mode or a floating mode is selected.
Figure 7:
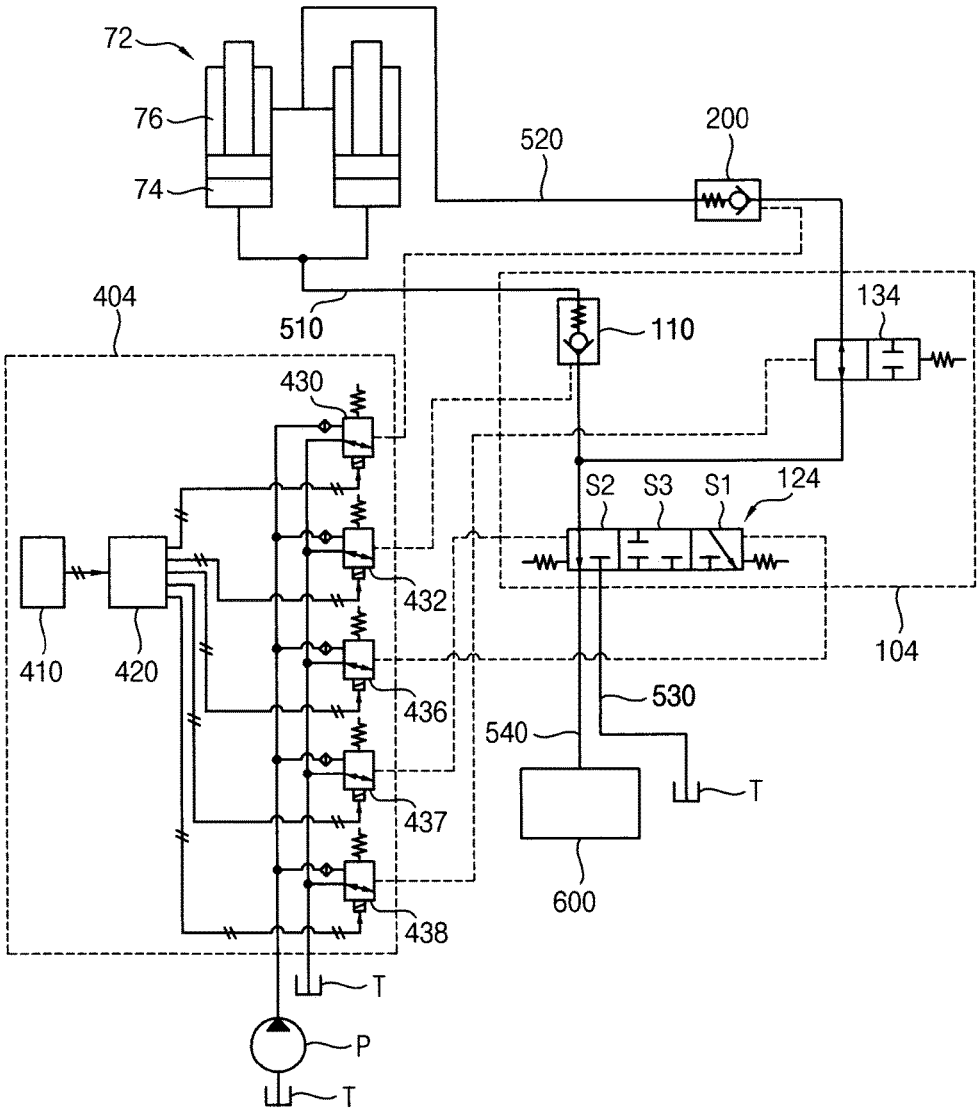
FIG. 7 is a hydraulic circuit diagram illustrating the hydraulic system in FIG. 5, when a control mode of a regeneration mode is selected.

FIG. 5 is a hydraulic circuit diagram illustrating a hydraulic system for construction machinery in accordance with example embodiments. FIG. 6 is a hydraulic circuit diagram illustrating the hydraulic system in FIG. 5, when a control mode of a breaker mode or a floating mode is selected. FIG. 7 is a hydraulic circuit diagram illustrating the hydraulic system in FIG. 5, when a control mode of a regeneration mode is selected. The hydraulic system for construction machinery may be substantially the same as or similar to the hydraulic system for construction machinery as described with reference to FIGS. 2 and 3, except for a hydraulic regeneration line for connection with a regeneration device, a regeneration valve unit and a control unit. Thus, same reference numerals will be used to refer to the same or like elements and any further repetitive explanation concerning the above elements will be omitted.

Referring to FIGS. 5 to 7, a hydraulic system for construction machinery in accordance with example embodiments may include a boom cylinder 72, a regeneration device 600 for energy recovery of a front work apparatus such as a boom, a regeneration valve unit 104, a first check valve 200 and a control unit 404 configured to control the regeneration valve unit 104 and the first check valve 200.

Although it is not illustrated in the figures, a boom control valve may be connected to a head-side chamber, that is, a raising-side chamber 74 of the boom cylinder 72 through a boom head hydraulic line, and the boom control valve may be connected to a rod-side chamber, that is, a lowering-side chamber 76 of the boom cylinder 72 through a boom rod hydraulic line. Accordingly, the boom control valve may be switched to selectively supply a working oil discharged from a hydraulic pump (not illustrated) to the head-side chamber or the rod-side chamber. The first hydraulic line 510 may be connected to the head-side chamber 74. The first hydraulic line 510 may be branched from the boom head hydraulic line. The second hydraulic line 520 may be connected to the rod-side chamber 76. The second hydraulic line 520 may be branched from the boom rod hydraulic line.

In example embodiments, the regeneration device 600 may regenerate energy using a high-pressure working oil discharged from the head-side chamber 74 of the boom cylinder 72 when the boom descends. For example, the regeneration device may include an accumulator, a hydraulic motor, etc. When a regeneration mode of the control mode is selected, the regeneration device 600 may receive the high-pressure working oil discharged from the head-side chamber 74. The regeneration device 600 may be connected to the head-side chamber 74 by a hydraulic regeneration line. The hydraulic regeneration line may include the first hydraulic line 510 and a regeneration connection line 540.

In particular, the regeneration valve unit 404 may be installed in the hydraulic regeneration line to control supply of the working oil to the regeneration device 600 and drainage of the working oil to the drain tank T.

The first opening/closing valve 124 of the regeneration valve unit 404 may selectively connect the head-side chamber 74 to the drain tank T or the regeneration device. As illustrated in FIG. 5, the first opening/closing valve 124 may have a first spool position S1 for connecting the head-side chamber 74 to the drain tank T and a second spool position S2 for connecting the head-side chamber 74 to the regeneration device 600. For example, the first opening/closing valve 120 may be a 3 position directional control valve. The first opening/closing valve 120 may have the first spool position S1, the second spool position S2 and a third spool position S3, that is, closed position.

When the first opening/closing valve 124 is switched to the first spool position S1, the first hydraulic line 510 may be opened. Thus, the working oil discharged from the head-side chamber 74 may be drained to the drain tank T through the first hydraulic line 510. The working oil discharged from the rod-side chamber 76 may be drained to the drain tank T through the second hydraulic line 520 and the third hydraulic line 530.

When the first opening/closing valve 124 is switched to the second spool position S2, the first hydraulic line 510 may be connected to the regeneration connection line 540 and may be disconnected to the drain tank T. Thus, the working oil discharged from the head-side chamber 74 may be drained to the regeneration device 600 through the first hydraulic line 510 and the regeneration connection line 540.

When the first opening/closing valve 124 is switched to the third spool position S3, the first hydraulic line 510 may be closed to be disconnected to the drain tank T and the regeneration device 600. The working oil discharged from the head-side chamber 74 may not be drained to the drain tank T through the first hydraulic line 510.

The second opening/closing valve 134 of the regeneration valve unit 404 may be installed in the second hydraulic line 520 which connects the first hydraulic line 510 and the rod-side chamber 76 to selectively a portion of the working oil discharged through the first hydraulic line 510 to the rod-side chamber 76. An end portion of the second hydraulic line 520 may be branched from the first hydraulic line 510 in the rear of the third check valve 110 and may be connected to the rod-side chamber 76 of the boom cylinder 72.

Although it is not illustrated in the figures, a second check valve may be additionally installed in the third hydraulic line 530 as a portion of the first hydraulic line 510 which connects the first opening/closing valve 124 and the drain tank T, that is, a portion of the first hydraulic line 510 in the rear of the first opening/closing valve 124, and may prevent the working oil discharged from the head-side chamber 74 and the rod-side chamber 76 being drained to the drain tank T.

In example embodiments, the control unit 404 may include first, second, third, fifth and sixth control valves 430, 432, 434, 437 and 438 for applying the pilot pressure, a selection portion 410 for selecting a control mode, and a controller 420 for applying electronic signals to the control valves 430, 432, 434, 437 and 438 according to the selected control mode. When the first and second opening/closing valves include an electronic solenoid valve (for example, electro proportional pressure reducing valve), the control unit may not include the control valves and may apply electronic signals to the first and second opening/closing valves.

For example, the control mode may include a breaker mode, a floating mode and a regeneration mode. The selection portion may output a selection signal to the controller in response to a selection of an operator or control logic. The selection portion may select one of the modes and output the selection signal to the controller. The selection portion may determine a control mode based on information inputted through a user interface such as a selection switch. Alternatively, the selection portion may include control logic capable of determining the control mode by calculating manipulation pattern information, to thereby automatically determine the control mode.

When the breaker mode is selected, the controller 420 may apply electronic signals to the second control valve 432, the fourth control valve 436 and the fifth control valves 438. The second, fourth and fifth control valves 432, 436 and 438 may generate a pilot pressure in response to the electronic signal outputted from the controller 420. The pilot pressure applied from the second control valve 432 may open the third check valve 110. The pilot pressure applied from the fourth control valve 436 may switch the first opening/closing valve 124 to the first spool position S1 to connect the first hydraulic line 510 and the third hydraulic line 530. The pilot pressure applied from the fifth control valve 438 may switch the second opening/closing valve 134 to open the second hydraulic line 520.

When the floating mode is selected, the controller 420 may apply electronic signals to the first control valve 430, the second control valve 432, the fourth control valve 436 and the fifth control valves 438. The first, second, fourth and fifth control valves 430, 432, 436 and 438 may generate a pilot pressure in response to the electronic signal outputted from the controller 420. The pilot pressure applied from the first control valve 430 may open the first check valve 200. The pilot pressure applied from the second control valve 432 may open the third check valve 110. The pilot pressure applied from the fourth control valve 436 may switch the first opening/closing valve 124 to the first spool position S1 to connect the first hydraulic line 510 and the third hydraulic line 530. The pilot pressure applied from the fifth control valve 438 may switch the second opening/closing valve 134 to open the second hydraulic line 520.

When the regeneration mode is selected, the controller 420 may apply electronic signals to the second control valve 432, the sixth control valve 437 and the fifth control valves 438. The second, sixth and fifth control valves 432, 437 and 438 may generate a pilot pressure in response to the electronic signal outputted from the controller 420. The pilot pressure applied from the second control valve 432 may open the third check valve 110. The pilot pressure applied from the sixth control valve 437 may switch the first opening/closing valve 124 to the second spool position S1 to connect the first hydraulic line 510 and the regeneration connection line 540. The pilot pressure applied from the fifth control valve 438 may switch the second opening/closing valve 134 to open the second hydraulic line 520.

Accordingly, in the regeneration mode, the working oil from the head-side chamber 74*a* of the boom cylinder 72 may be supplied to the regeneration device 600 through the hydraulic regeneration line 510, 540 to recover potential energy of the boom.

The present invention has been explained with reference to preferable embodiments, however, those skilled in the art may understand that the present invention may be modified or changed without being deviated from the concept and the scope of the present invention disclosed in the following claims.

<The description of the reference numerals>

| | | | |
|---|---|---|---|
| 10: | construction machinery | 20: | lower travelling body |
| 30: | upper swing body | 32: | upper frame |
| 40: | counterweight | 50: | cabin |
| 60: | work apparatus | 70: | boom |
| 72: | boom cylinder | 74: | head-side chamber |
| 76: | rod-side chamber | 80: | arm |
| 90: | bucket | 100, 102, 104: | regeneration valve unit |
| 110: | third check valve | 120, 122, 124: | first opening/closing valve |
| 130, 132, 134: | second opening/closing valve | 200: | first check valve |
| 300: | second check valve | 400, 402: | control unit |
| 410: | selection portion | 420: | controller |
| 430: | first control valve | 432: | second control valve |
| 434: | third control valve | 436: | forth control valve |
| 437: | sixth control valve | 438: | fifth control valve |
| 510: | first hydraulic line | 520: | second hydraulic line |
| 530: | third hydraulic line | 540: | regeneration connection line |
| T: | drain tank | P: | pilot pump |

The invention claimed is:

1. A hydraulic system for construction machinery, comprising:

a regeneration valve unit including a first opening/closing valve installed in a first hydraulic line which connects a head-side chamber of a boom cylinder and a drain tank and configured to open and close the first hydraulic line, a second opening/closing valve installed in a second hydraulic line which is branched from the first hydraulic line and is connected to a rod-side chamber of the boom cylinder and configured to open and close the second hydraulic line, and a third check valve in the first hydraulic line between the head-side chamber and the first opening/closing valve and configured to open and close the first hydraulic line to selectively drain the working oil discharged from the head-side chamber to the drain tank through the first opening/closing valve, the boom cylinder including the head-side chamber in a side of a cylinder head and the rod-side chamber in a side of a cylinder rod;

a first check valve installed in the second hydraulic line between the rod-side chamber and the regeneration valve unit and configured to selectively drain a working oil discharged from the rod-side chamber to the drain tank; and a control unit configured to control opening and closing of the first opening/closing valve, the second opening/closing valve, the first check valve and the third check valve according to a control mode, wherein the third check valve is a pilot-operated check valve held open by a pilot pressure, and wherein the control unit comprises a controller configured to apply electronic signals to a plurality of control valves according to the control mode, the control valves applying pilot pressure for opening and closing the first opening/closing valve, the second opening/closing valve, the first check valve and the third check valve.

2. The hydraulic system for construction machine of claim 1, further comprising a second check valve installed in the first hydraulic line between the regeneration valve unit and the drain tank and configured to open and close the first hydraulic line to prevent the working oil discharged from the head-side chamber and the rod-side chamber from flowing to the drain tank.

3. The hydraulic system for construction machinery of claim 1, wherein the control unit further comprises a selection portion configured to select a breaker mode or a floating mode as the control mode, the breaker mode operable to connect the head-side chamber to the drain tank, the floating mode operable to connect the head-side chamber and the rod-side chamber to the drain tank.

4. The hydraulic system for construction machinery of claim 3, wherein when the breaker mode is selected, the control unit applies the pilot pressure to the first opening/closing valve and the second opening/closing valve.

5. The hydraulic system for construction machinery of claim 3, wherein when the floating mode is selected, the control unit applies the pilot pressure to the first opening/closing valve, the second opening/closing valve and the first check valve.

6. The hydraulic system for construction machinery of claim 1, wherein the first and second opening/closing valves include a solenoid valve respectively and the control unit applies electronic signals for opening and closing the first and second opening/closing valves according to the control mode.

7. The hydraulic system for construction machinery of claim 1, further comprising a regeneration device configured to recover energy of the cylinder, and wherein the first opening/closing valve selectively connects the head-side chamber to the drain tank or the regeneration device.

8. The hydraulic system for construction machinery of claim 7, wherein the first opening/closing valve has a first spool position where the first hydraulic line is opened such that the head-side chamber is connected to the drain tank and a second spool position where the first hydraulic line is connected to a regeneration connection line such that the head-side chamber is connected to the regeneration device.

9. The hydraulic system for construction machinery of claim 7, wherein when the breaker mode or the floating mode is selected, the control unit switches the first opening/closing valve to the first spool position to connect the head-side chamber to the drain tank, and when a regeneration mode is selected, the control unit switches the first opening/closing valve to the second spool position to connect the head-side chamber to the regeneration device.

10. The hydraulic system for construction machinery of claim 7, wherein the regeneration device includes an accumulator or a hydraulic motor.

11. The hydraulic system for construction machinery of claim 1, wherein the second hydraulic line is connected to a portion of the first hydraulic line in the front of the first opening/closing valve or in the rear of the first opening/closing valve.

* * * * *